US010803693B2

(12) United States Patent
Debarge

(10) Patent No.: US 10,803,693 B2
(45) Date of Patent: Oct. 13, 2020

(54) PILL DISPENSER FOR TAPERING DOSAGE

(71) Applicant: Antoine Debarge, West Hollywood, CA (US)

(72) Inventor: Antoine Debarge, West Hollywood, CA (US)

( * ) Notice: Subject to any disclaimer, the term of this patent is extended or adjusted under 35 U.S.C. 154(b) by 0 days.

(21) Appl. No.: 16/508,742

(22) Filed: Jul. 11, 2019

(65) Prior Publication Data

US 2020/0134962 A1 Apr. 30, 2020

Related U.S. Application Data

(60) Provisional application No. 62/751,928, filed on Oct. 29, 2018.

(51) Int. Cl.
*G07F 17/00* (2006.01)
*A61J 7/00* (2006.01)

(52) U.S. Cl.
CPC ..... *G07F 17/0092* (2013.01); *A61J 7/0076* (2013.01)

(58) Field of Classification Search
None
See application file for complete search history.

(56) References Cited

U.S. PATENT DOCUMENTS 6,286,714 B1 * 9/2001 Pearson ..... A61J 7/02 221/164

* cited by examiner

*Primary Examiner* — Gene O Crawford
*Assistant Examiner* — Ayodeji T Ojofeitimi
(74) *Attorney, Agent, or Firm* — Trojan Law Offices

(57) ABSTRACT

A medication dispenser device comprises a loading device and a portable plate. The loading device configured to load pills further includes at least one loading compartment, a loading member and an air piston. The loading tubing is capable of selecting predetermined number of pills to inject into the portable plate. Through the air piston. The portable plate has a first annular plate attached with a second annular plate. The first and second annular plate include a plurality of channels. The channels has first sections in the first annular plate and second sections in the second annular plate such that the pills are loaded in the first sections of the channel when the second sections of the channels are fully loaded. The portable plate is capable of separating from the loading device when the pills are fully loaded in the channels.

19 Claims, 9 Drawing Sheets

PILL DISPENSER FOR TAPERING DOSAGE

CROSS-REFERENCE TO RELATED APPLICATIONS

The application claims priority to and benefit of U.S. Provisional Patent Application No. 62/751,928, filed on Oct. 29, 2018, which is incorporated by reference in its entirety.

FIELD OF THE INVENTION

The present invention relates to an apparatus for pills dispensing, and more particularly, a portable pill dispenser device for patients to easily carry their drugs, and to assist patients in weaning off drugs.

BACKGROUND OF THE INVENTION

Despite growing concerns that opioid prescriptions are promoting widespread addiction and overdose deaths, more than one out of three Americans were prescribed opioids in 2015. Nearly 92 million adults in the U.S., or about 38% of the population, took prescribed opioids such as OxyContin or Percocet in 2015, according to the results from the National Survey on Drug Use and Health.

Generally, after surgery or trauma, patients are frequently prescribed pain relievers, such as Hydrocodone, for an extended period of time. This can lead to varying degrees of dependency. When the pain becomes manageable after the surgery or trauma, the patient often faces two options: The patient can quit taking the pain reliever immediately or the patient can gradually taper off the medication to minimize withdrawal systems. Patients tapering off opioid medications must follow a strict and challenging regiment, in which they are supposed to decrease the dosage of their medication in the approximate amount of 2.5~5.0 mg per week. As a result of the addictive nature of opioids, it is easy for the patient to fail to adhere to this process.

The current invention is to help patients to wean off hydrocodone or buprenorphine by only allowing access to the medication in accordance with the tapering schedule. In addition, the invention offers an alternative for patents who cannot afford the cost of months of rehabilitation necessary to treat opiates dependency and/or provides an opportunity for patients to avoid addiction. For example, in one embodiment of the present invention, the following advantages are provided: (1) The invention can deliver decreasing amount of medications over time; (2) A loading device is provided in which the patients, doctors, or pharmacy can add two prescriptions bottles of two different dosages into two different loading compartments such that the portable device can be loaded by the loading device; (3) An application in cell phones provides a platform for small groups of patients in order to establish a "less virtual" community to share the progress of the process of weaning off medications.

The object of the present invention is to provide a convenient pill dispenser device that allows the user to carry the drugs easily with them.

More specifically, the object of the present invention provides a pill dispenser device that assist the user in weaning off addictive drugs.

SUMMARY OF THE INVENTION

In accordance with the objectives of the invention, the embodiments of the present invention relate to a medication dispenser device. The medication dispenser device comprises a loading device and a portable plate. The loading device includes at least one loading compartment for loading pills, a loading member, and an air piston. The loading member further includes a vacuum straw and a Y-shaped tube. The vacuum straw is capable of picking the pills from the loading compartments into the Y-shaped tube. The air piston is capable of injecting a predetermined number of pills into the portable device. The air piston is further configured to be wirelessly controlled to inject the predetermined number of pills. The portable plate is capable of receiving the pills from the loading device. The portable plate further has a first annular plate attached with a second annular plate. The annular plate includes a plurality of channels, which intersect each other in the attached first and the second annular plate. The channel further includes first sections in the first annular plate and second sections in the second annular plate.

In one embodiment, the portable plate has a stopper configured to separate the first sections and the second sections of the channels. The stopper is configured to be inserted into the attached first and second annular plate such that the pills can be loaded in the first sections of the channels when the second sections of the channels are fully loaded.

In one embodiment, each channel also has a slot opening for receiving the pills from the air piston. The portable plate is rotatable so that the pills can be loaded into the plurality of channels in the annular plates. In a preferred embodiment, when the pills are fully loaded in the channels, the portable plate is capable of separating from the loading device.

In one embodiment of the medication dispenser device, there is provided a medication dispensing method. The method comprises receiving the pills from the loading devices through the air piston such that the pills are injected into the plurality of channels. In one embodiment, the portable plate can be rotated such that the pills can be loaded into different channels. In a preferred embodiment, the portable plate includes the first annular plate attached with the second annular plate such that the pills are loaded in the second sections of said second annular plate before loaded in the first sections of said first annular plate.

In a preferred embodiment, the method further comprises separating the portable plate from the loading device when the pills are fully loaded in the plurality of channels.

These and other objects, advantages, and features of the invention will be more fully understood and appreciated by reference to the detailed description of the current embodiments and the drawings.

DETAILED DESCRIPTION OF EMBODIMENTS

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and to fully convey the scope of the invention to those skilled in the art.

Figure 1:
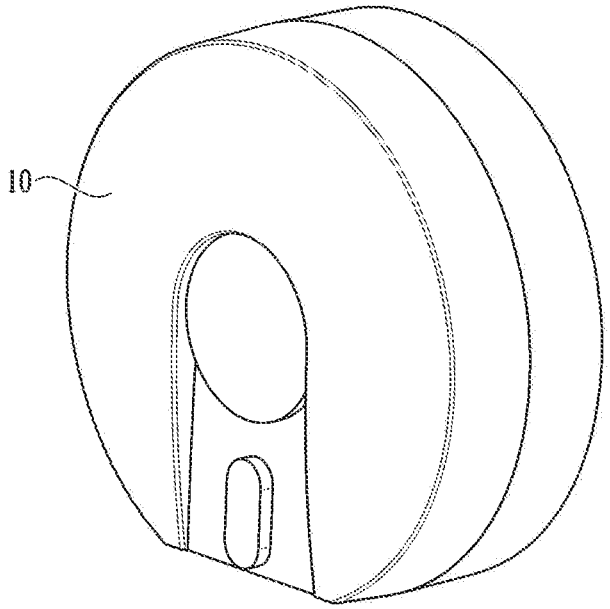
FIG. 1 illustrates a front perspective view of an embodiment of the portable device.
Figure 2:
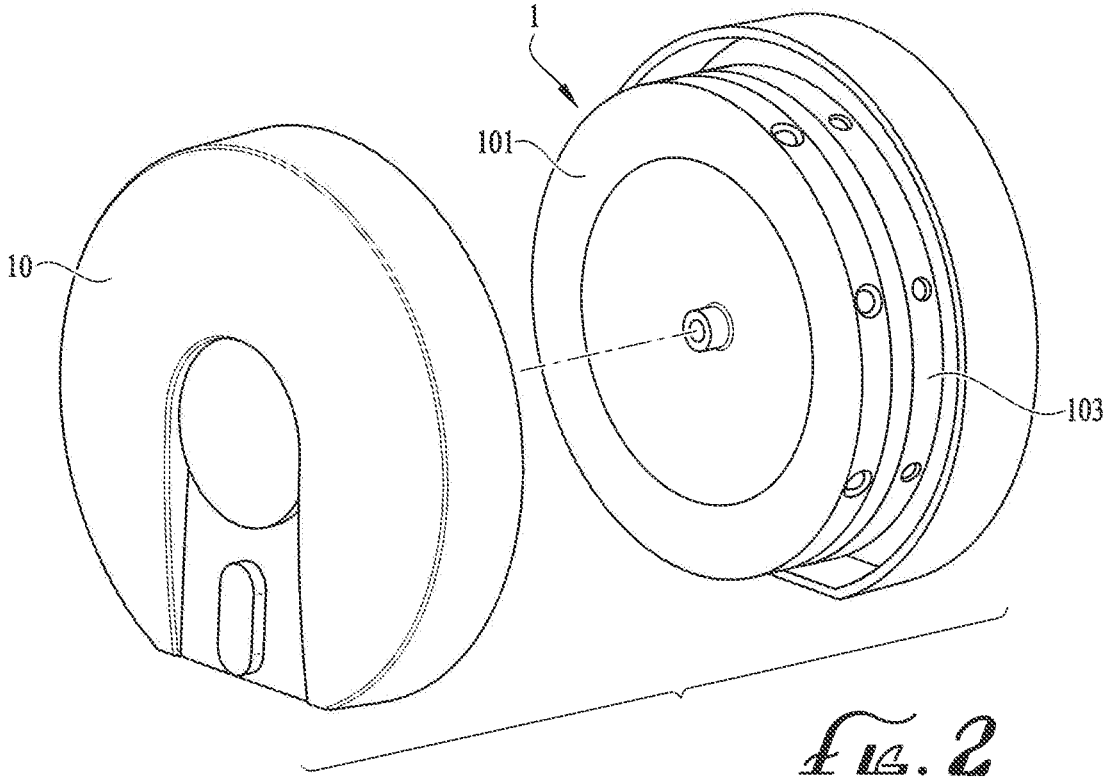
FIG. 2 illustrates an exploded view of the embodiment of the portable device.
Figure 3:
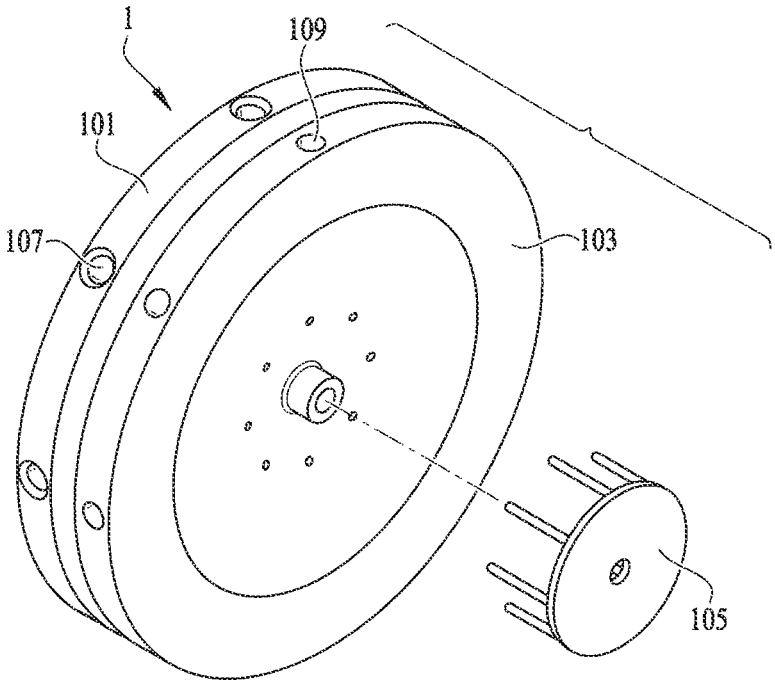
FIG. 3 illustrates an embodiment of the portable plate of the present invention.
Figure 4:
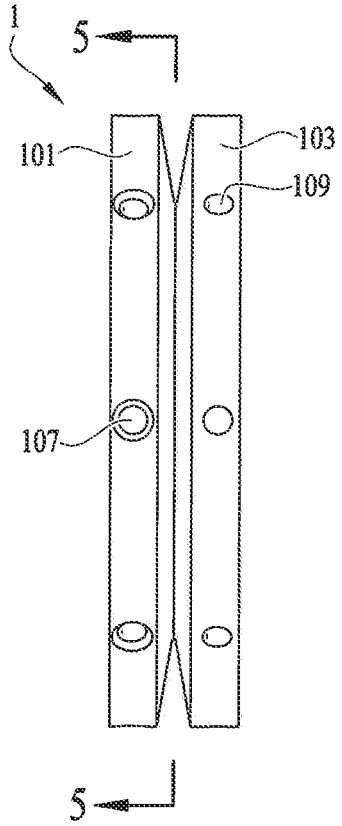
FIG. 4 illustrates a side view of the portable plate of FIG. 3.
Figure 5:
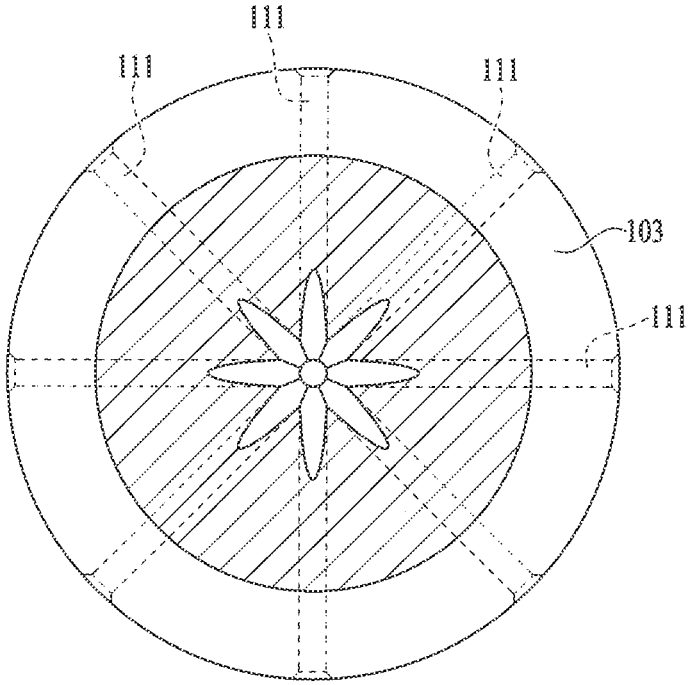
FIG. 5 illustrates a cross sectional view of the portable plate of FIG. 4.
Figure 9:
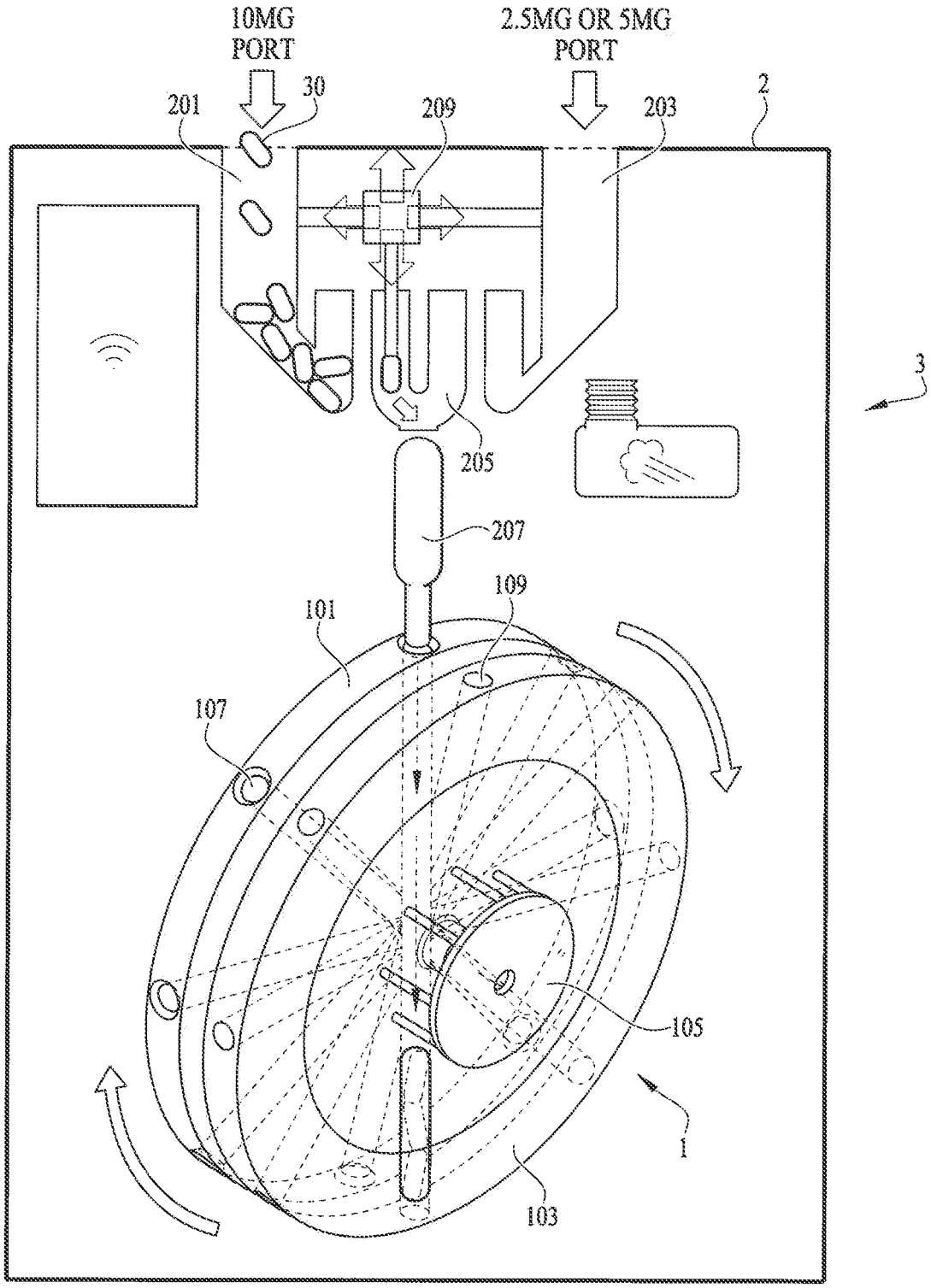
FIG. 9 illustrates a front view of an embodiment of the medication dispenser device.

A medication dispenser device 3, as shown in FIG. 9, comprises a portable plate 1, and a loading device 2. As shown in FIG. 1 and FIG. 2, a portable plate 1 according to an embodiment of the invention is comprised of a first annular plate 101 attached with a second annular plate 103. The portable plate 1 is configured to be placed inside the case 10 such that it is easy for the users to carry the pills with them. In one embodiment, as shown in FIG. 3, FIG. 4 and FIG. 5, the portable plate 1 has slot openings 107, 109 for receiving pills and for unloading the pills from the loading device 2. In another embodiment, a stopper 105 can be inserted into the center of the annular plates 101, 103, to separate channels 111, as shown in FIG. 5.

Figure 6:
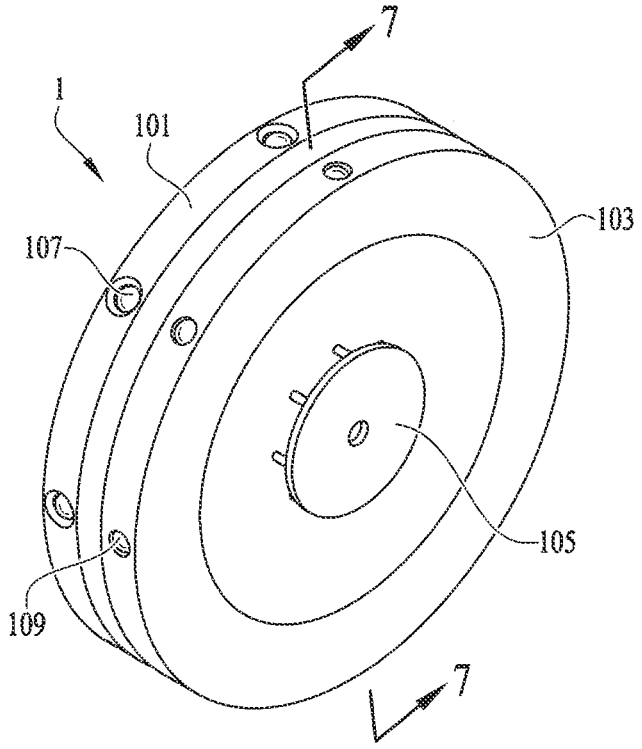
FIG. 6 illustrates a perspective view of the portable plate and the stopper.
Figure 7:
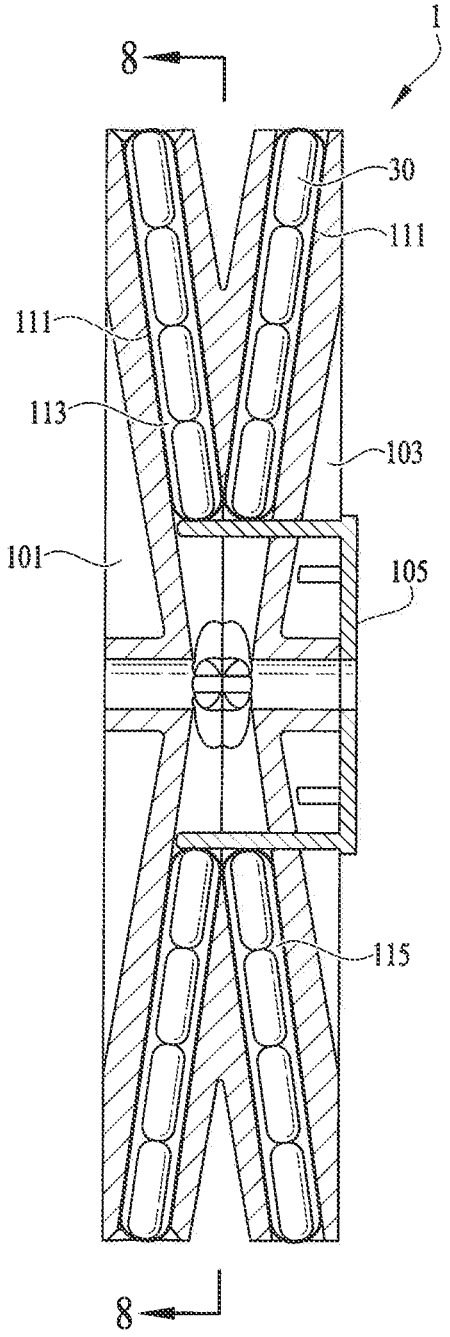
FIG. 7 illustrates a cross sectional view of the portable plate and the stopper of FIG. 6.
Figure 8:
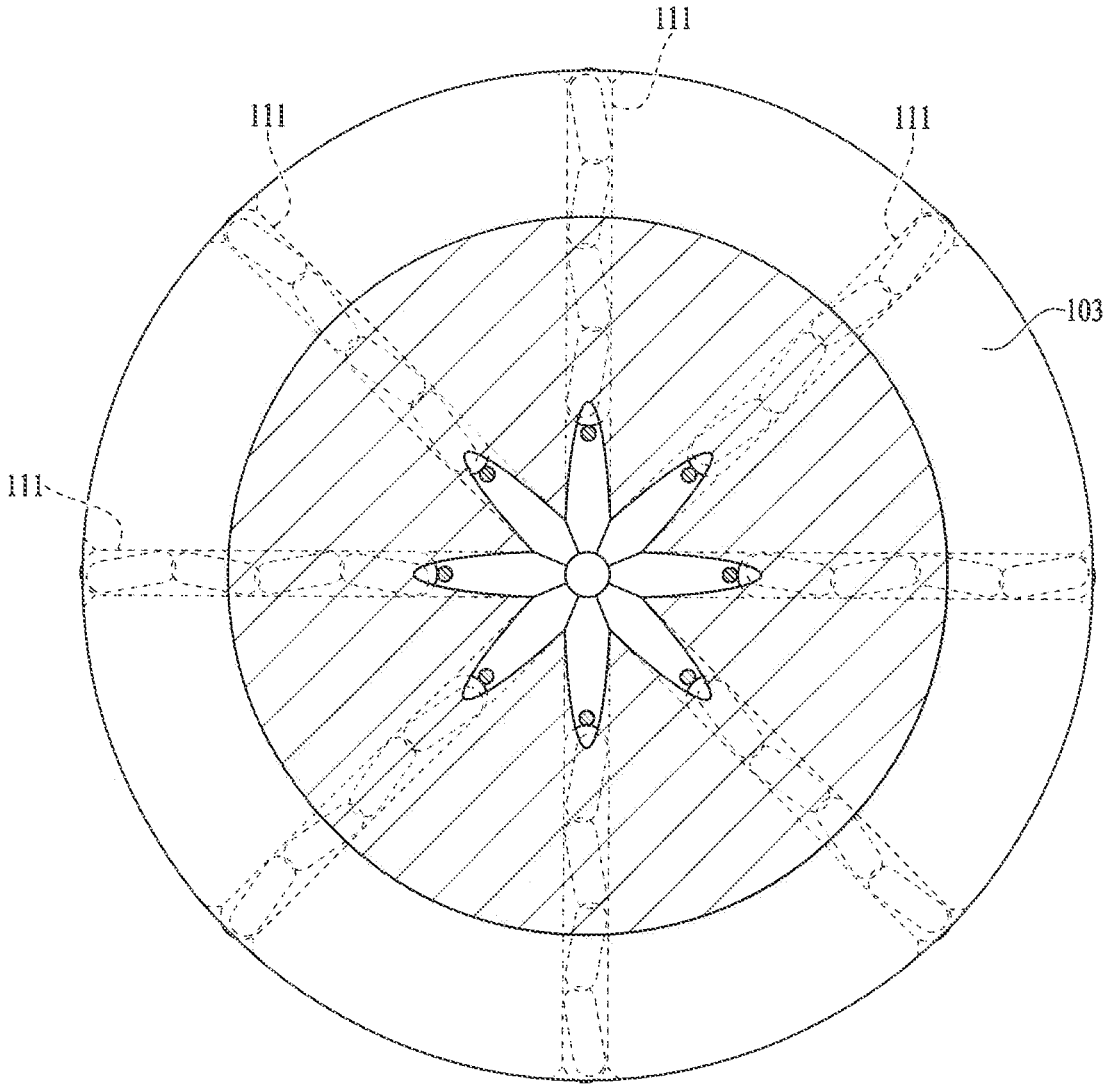
FIG. 8 illustrates a cross sectional view of the portable plate and the stopper of FIG. 7.

Referring now to FIG. 6, FIG. 7 and FIG. 8, the first and annular plate 101, 103, are attached to each other. In one embodiment, a plurality of channels 111 are located inside the first and the second annular plate 101, 103 that intersect each other, as shown in FIG. 7 and FIG. 8. The channels, as shown in FIG. 7, are capable of receiving the pills 30. Each channel includes a first section 113 in the first annular plate 101 and a second section 115 in the second annular plate 103. In a preferred embodiment, the pills 30 are loaded in the second sections 115 of the second annular plate 103 before loaded in the first sections 113 of the first annular plate 101. In one embodiment, the stopper 105 separates the pills 30 between the first annular plate 101 and the second annular plate 103. In a preferred embodiment, after all of the second sections 115 of the channels 111 are fully loaded in the second annular plate 103, the stopper 105 is placed at the center of the portable plate 1 such that the pills 30 can be then be filled in the first sections 113 in the first annular plate 101, as shown in FIG. 7. FIG. 8 shows the pills 30 are fully loaded in the channels 111 inside the annular plate 103.

FIG. 9 shows one embodiment of a loading device 2 with the portable plate 1 inside. In one embodiment, the portable plate 1 is placed inside the loading device 2 for receiving a specific quantity of the pills 30 as shown in FIG. 9. The loading device 2 includes at least one loading compartment 201, 203, a loading member having a vacuum straw 209, a Y-shaped tube 205, and an air piston 207. In a preferred embodiment, the vacuum straw 209 in the loading device 2 picks the pills 30 one by one in the loading compartments 201, 203. The loading compartments 201, 203 are loaded with different dosages of the prescription drugs 30. The drugs 30 that are picked by the vacuum straw 209 are then released into the Y-shaped tube 205.

In a preferred embodiment, the loading device 2 is wirelessly connected to a computer or an application (not shown) such that it will validate a predetermined weight conformed to the appropriate pill amounts for a particular schedule dose. The computer is connected to a sensing device that registers the weight of each pill of different dosages for loading in the loading compartments 201, 203 and, combined with the total amount of pills recorded in the computer or the application, the computer can prevent an inaccurate quantity of pill from entering the Y-shaped tube 205. After the pills 30 are accurately dispensed in the Y-shaped tube 205, the predetermined number of pills are loaded into channels 111 of the portable plate 1 via the air piston 207. As shown in FIG. 9, the portable plate 1 is rotatable when loading the pills 30 such that the pills 30 can be loaded into the different channels 111.

Figure 10:
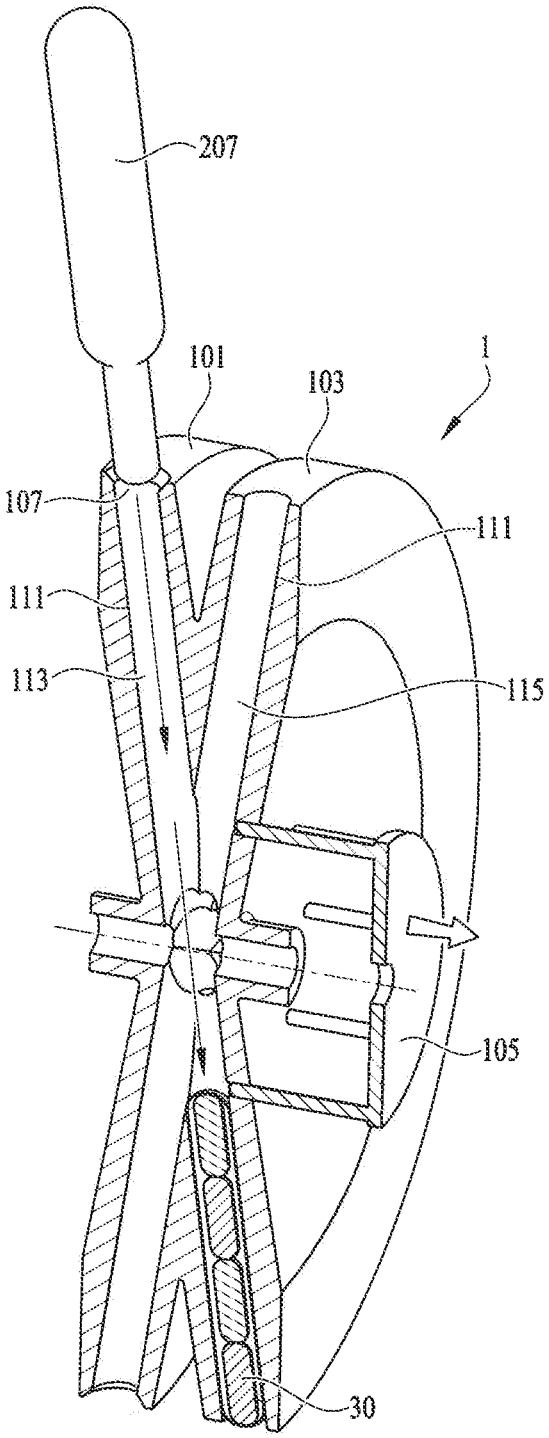
FIG. 10 illustrates a cross sectional view of the portable plate and the stopper of FIG. 7 having the air piston injecting the pills into the channels.
Figure 11:
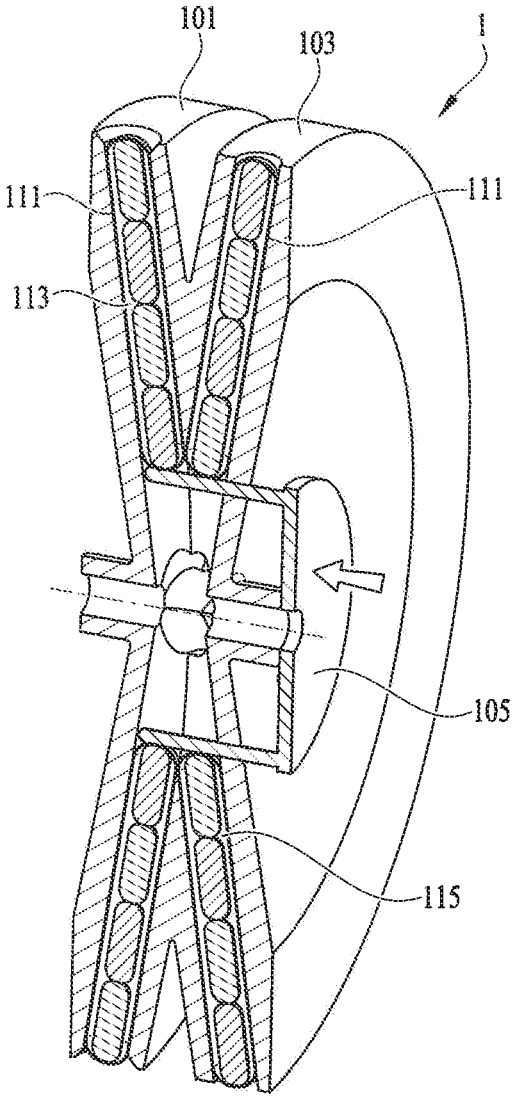
FIG. 11 illustrates a cross sectional view of the portable plate and the stopper of FIG. 7, having pills fully loaded in the channels.

In one embodiment, the computer or the application that is wirelessly connected to the loading device 2 can remotely control the air piston 207, ordering the air piston 207 to inject the required numbers of pills 30 to fill the channels 111 in the portable plate 1. As shown in FIG. 9 and FIG. 10, the pills 30 are injected from the air piston 207 to the channels 111 through slot openings 107 on the first annular plate 101. As shown in FIG. 10, the pills 30 are firstly loaded in the second sections 115 of the second annular plate 103. Referring now to FIG. 11, once the second sections 115 of the second annular plate 103 are fully loaded, the stopper 105 is placed at the center of the annular plate 101, 103 to separate the channels 111 such that the pills 30 will then be filled in the first sections 113 of the first annular plate 101. In one embodiment, when the pills 30 are fully loaded in the portable plate 1, the portable plate 1 will be removed from the loading device 2. In one embodiment, as shown in FIG. 1 and FIG. 2, the fully loaded portable plate 1 is placed inside the case 10 such that the user can carry the portable plate 1 easily.

Figure 12:
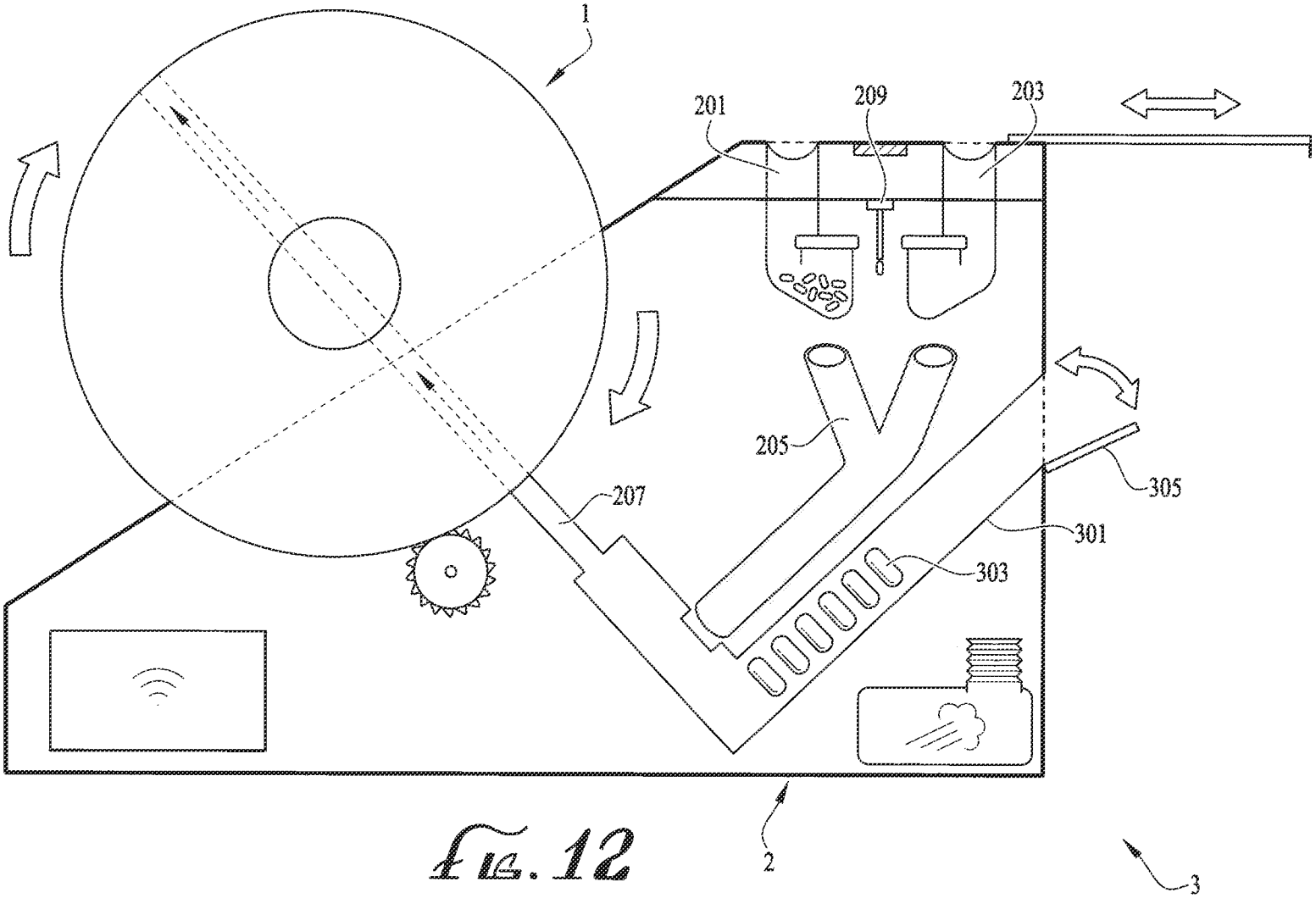
FIG. 12 illustrates a perspective view of an embodiment of the loading device with the portable plate.
Figure 13:
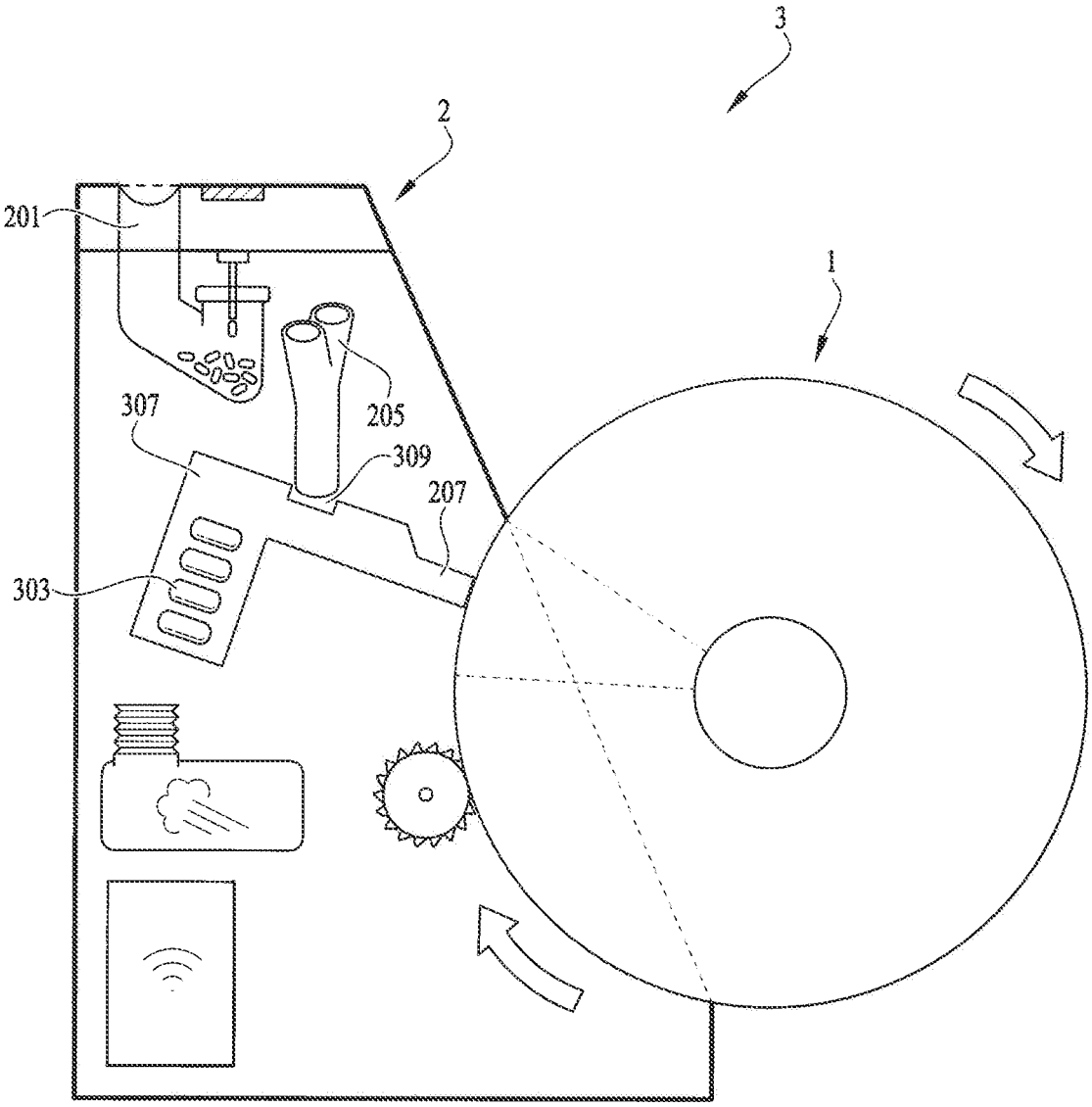
FIG. 13 illustrates a perspective view of another embodiment of the loading device with the portable plate.
Figure 14:
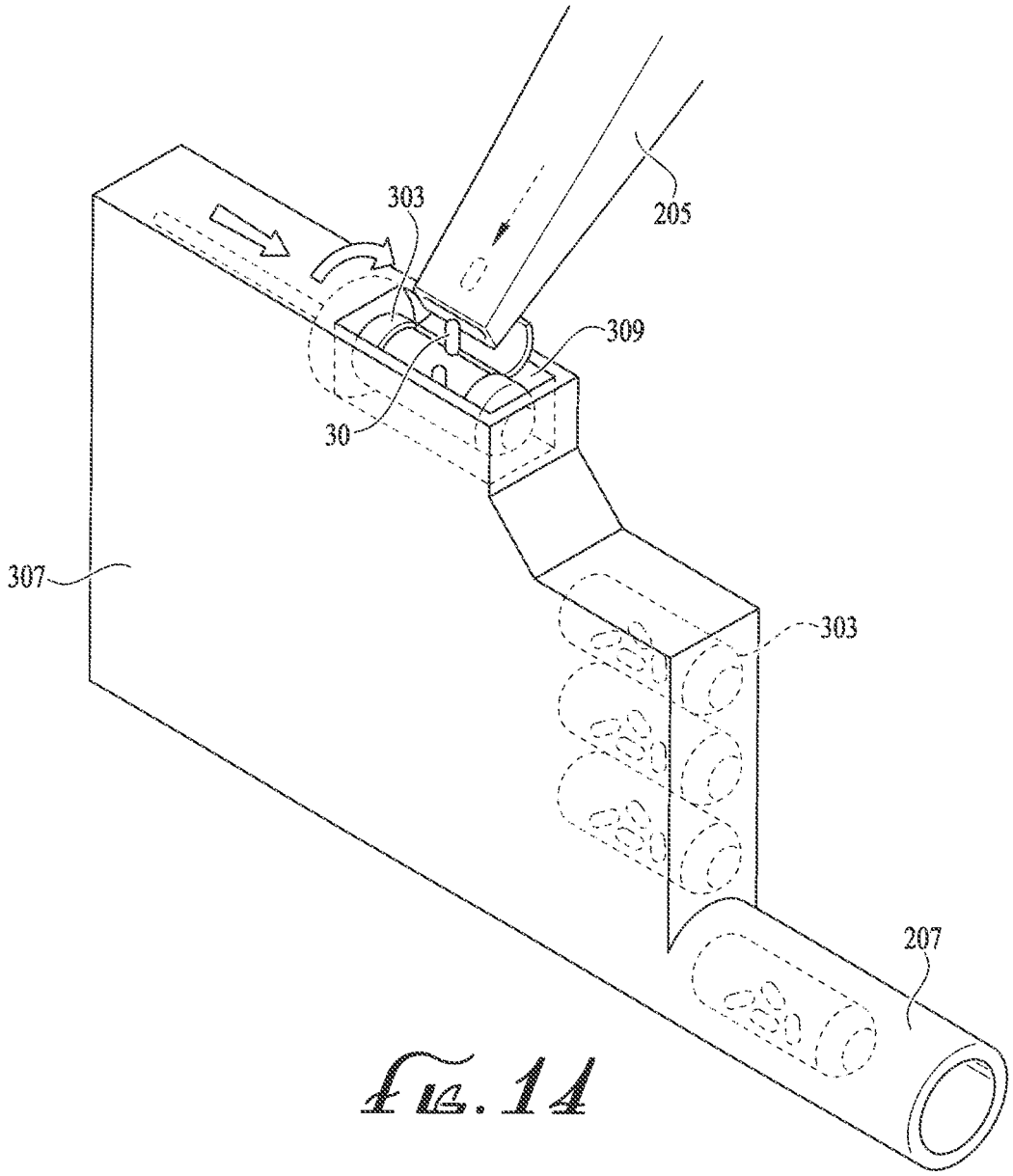
FIG. 14 illustrates a perspective view of the embodiment of the medication dispenser device of FIG. 13 with pill packaging in the pill cartridge.

In a preferred embodiment, as shown in FIG. 12 and FIG. 13, the loading device 2 comprises a pill packaging reservoir 301, 307 for storing pill cartridges 303. As shown in FIG. 12, the pill packaging reservoir 301 has an opener 305 for the user to store the pill cartridges 303 inside the loading device 2. The pill packaging reservoir 301 is connected to the air piston 207 such that the pill cartridges 303 can be injected into the portable plate 1. FIG. 13 shows an embodiment having only one loading compartment 201. As shown in FIG. 13, the pill packaging reservoir 307 include a packaging space 309 beneath the Y-shaped tube 205 in the loading device 2. Referring now to FIG. 14, in one embodiment, when the pill cartridge 303 is placed beneath the Y-shaped tube 205, the pills 30 will be loaded into the pill cartridge 303 such that the pill cartridge 303 will fold and the pills 30 are locked inside the pill cartridge 303. The locked pill cartridge 303 will then be injected by the air piston 207 to the channels 111 in the portable plate 1.

While illustrative embodiments of the invention have been described in detail above, it is to be understood that the appended claims are intended to be construed to include variations of the present invention.

What is claimed is:

1. A medication dispensing method, said method comprising:

receiving pills from at least one loading device to a portable plate through an air piston;

injecting said pills into a plurality of channels in said portable plate;

rotating said portable plate such that said pills can be loaded into different said channels;

separating said portable plate from said loading device when the pills are fully loaded in said plurality of channels;

wherein said loading device includes a first annular plate attached with a second annular plate such that said pills are loaded in second sections of said second annular plate before loaded in first sections of said first annular plate.

2. A medication dispensing method of claim 1, wherein said air piston is capable of injecting predetermined number of pills to said portable plate.

3. A medication dispensing method of claim 1, further comprising separating said pills in said first sections from said second sections of said channels via a stopper.

4. A medication dispenser device, comprising:

a loading device, said loading device further having:

at least one loading compartment;

a loading member, said loading member further having a vacuum straw and a Y-shaped tube, wherein said vacuum straw is capable of picking said pills from said loading compartment;

an air piston capable of capable of injecting predetermined number of pills to said portable plate;

a portable plate, further having:

a first annular plate attached with a second annular plate, said annular plate including a plurality of channels, a stopper capable of separating said pills;

said channels having slot openings on said channels for receiving said pills from said air piston first sections in said first annular plate and second sections in said second annular plate;

wherein said stopper is configured to be inserted into said attached first and second annular plate such that the pills can be loaded in said first sections of said channels when said second sections of said channels are fully loaded wherein said portable plate is rotatable such that said pills can be loaded into said channels;

wherein said portable plate is capable of receiving said pills from said loading device;

wherein said portable plate is capable of separating from said loading device when the pills are fully loaded.

5. A medication dispenser device of claim 4, wherein said vacuum straw is capable of selecting predetermined number of pills into said Y-shaped tube.

6. A medication dispenser device of claim 5, wherein said vacuum straw is configured to be wirelessly controlled to select said predetermined number of pills to said Y-shaped tube.

7. A medication dispenser device of claim 4, wherein said air piston is capable of injecting predetermined number of pills to said portable plate.

8. A medication dispenser device of claim 7, wherein said air piston is configured to be wirelessly controlled to inject said predetermined number of pills to said portable plate.

9. A medication dispenser device, comprising:

a loading device configured to load pills, said loading device further having:

at least one loading compartment;

a loading member;

an air piston capable of injecting said pills from said loading member;

a portable plate, further having:

a first annular plate attached with a second annular plate, said annular plate including a plurality of channels, said channels having first sections in said first annular plate and second sections in said second annular plate;

wherein said channels intersect each other in said portable plate;

wherein said portable plate is rotatable such that said pills can be loaded into said channels;

wherein said portable plate is capable of receiving said pills from said loading device.

10. A medication dispenser device, comprising:

a loading device configured to load pills, said loading device further having:

at least one loading compartment;

a loading member;

an air piston capable of injecting said pills from said loading member;

a portable plate, further having:

a first annular plate attached with a second annular plate, said annular plate including a plurality of channels, said channels having first sections in said first annular plate and second sections in said second annular plate;

said portable plate further having a stopper configured to separate said first sections and said second sections of said channels;

wherein said portable plate is rotatable such that said pills can be loaded into said channels;

wherein said portable plate is capable of receiving said pills from said loading device.

11. A medication dispenser device of claim 10, wherein said stopper is configured to be inserted into said attached first and second annular plate such that the pills can be loaded in said first sections of said channels when said second sections of said channels are fully loaded.

12. A medication dispenser device, comprising:

a loading device configured to load pills, said loading device further having:

at least one loading compartment;

a loading member;

an air piston capable of injecting said pills from said loading member;

a portable plate, further having:

a first annular plate attached with a second annular plate, said annular plate including a plurality of channels, said channels having first sections in said first annular plate and second sections in said second annular plate;

wherein said channels intersect each other in said attached first and second annular plate;

wherein said portable plate is rotatable such that said pills can be loaded into said channels;

wherein said portable plate is capable of receiving said pills from said loading device.

13. A medication dispenser device, comprising:

a loading device configured to load pills, said loading device further having:

at least one loading compartment;

a loading member, said loading member having a vacuum straw and a Y-shaped tube, wherein said vacuum straw is capable of picking said pills from said loading compartment, an air piston capable of injecting said pills from said loading member;

a portable plate, further having:

a first annular plate attached with a second annular plate, said annular plate including a plurality of channels, said channels having first sections in said first annular plate and second sections in said second annular plate;

wherein said portable plate is rotatable such that said pills can be loaded into said channels;

wherein said portable plate is capable of receiving said pills from said loading device.

14. A medication dispenser device of claim 13, wherein said portable plate is capable of separating from said loading device.

15. A medication dispenser device of claim 13, said channels having slot openings for receiving said pills from said air piston.

16. A medication dispenser device of claim 13, wherein said vacuum straw is capable of selecting predetermined number of pills into said Y-shaped tube.

17. A medication dispenser device of claim 16, wherein said vacuum straw is configured to be wirelessly controlled to select said predetermined number of pills to said Y-shaped tube.

18. A medication dispenser device of claim 13, wherein said air piston is capable of injecting predetermined number of pills to said portable plate.

19. A medication dispenser device of claim 18, wherein said air piston is configured to be wirelessly controlled to inject said predetermined number of pills to said portable plate.

* * * * *